US005303612A

United States Patent [19]

Odom et al.

[11] Patent Number: 5,303,612

[45] Date of Patent: Apr. 19, 1994

[54] INCREASED DIAMETER DETACHABLE THERMOSTAT KNOB ALLOWING EASIER THERMOSTAT USE

[75] Inventors: James A. Odom, Apple Valley; Dale A. Lindsley, Hamel, both of Minn.

[73] Assignee: Honeywell Inc., Minneaplis, Minn.

[21] Appl. No.: 996,462

[22] Filed: Dec. 24, 1992

[51] Int. Cl.[5] ..... G05G 1/10

[52] U.S. Cl. ..... 74/553; 16/121

[58] Field of Search ..... 74/553; 16/121, 117; 337/380

[56] References Cited

U.S. PATENT DOCUMENTS

| | | | |
|---|---|---|---|
| 2,688,678 | 9/1954 | Henderson | 74/553 X |
| 2,773,437 | 12/1956 | Knauf | 74/553 X |
| 3,410,247 | 11/1968 | Dronberger | 74/553 X |
| 4,285,536 | 8/1981 | McCoy et al. | 292/DIG. 2 X |
| 4,692,051 | 9/1987 | Stansbury, Jr. et al. | 74/553 X |
| 4,783,883 | 11/1988 | Szalay | 292/DIG. 2 X |
| 4,913,479 | 4/1990 | Allison | 292/DIG. 2 X |

*Primary Examiner*—Allan D. Herrmann
*Attorney, Agent, or Firm*—Edward L. Schwarz

[57] ABSTRACT

A knob accessory for a round thermostat of the type having a centrally located thermostat adjustment knob, has a relatively large diameter which allows easier adjustment of the thermostat setting for people who have difficulty in rotating an adjustment knob having detents to indicate thermostat settings. The knob accessory latches onto the standard adjustment knob with a detent mechanism which also allows removing the knob.

11 Claims, 2 Drawing Sheets

INCREASED DIAMETER DETACHABLE THERMOSTAT KNOB ALLOWING EASIER THERMOSTAT USE

BACKGROUND OF THE INVENTION

The round thermostat which was originally pioneered by the assignee of this patent has become one of the most ubiquitous features of the modern home. It has been produced in a number of different versions, but all have a number of common features. These include a housing having a generally circular periphery with a central axis and a front face on which is carried a scale of the thermostat setting. For adjustment of the thermostat setting, there is a thermostat knob having an axis of rotation coinciding with the central axis. The thermostat knob has a predetermined external shape which includes a circular wall projecting from the housing. A pointer on the thermostat knob indicates the current setting on the scale. Typically, the diameter of the housing may be 70–100 mm. and the thermostat knob may be 50–60 mm. in diameter.

A version now available is intended for use by the vision impaired. This version has extra large (over 8 mm.) raised numbering on the scale, and a detent which clicks for each 2F. rotation of the thermostat knob. The temperature settings divisible by 10 have a looser detent which creates a distinguishable tactile impression compared to the detents in the other setting positions. The two types of detent allow a person with very severe vision impairment to adjust the thermostat setting by tactile sense only since it is easy to estimate within 10F. the current temperature setting from the temperature level of the room.

It is not uncommon that people who have vision impairment also have strength impairment. This circumstance may arise from old age or from diseases which affect both their strength and their vision. Because of their vision impairment, the vision-impaired model is very desirable, but their strength impairment causes them difficulty in rotating the thermostat knob of a vision-impaired version against the resistance of the detent.

BRIEF DESCRIPTION OF THE INVENTION

The solution which we have developed to make the vision-impaired version of the round thermostat more accessible provides a knob accessory whose outer diameter is larger than the standard knob and which slips onto the standard knob. The larger outer diameter of the knob accessory reduces the strength needed for adjusting the thermostat setting. In order to avoid the additional cost of the larger knob for those who don't need it, or to allow retro-fitting of the larger knob to already installed thermostats, the knob is designed to be removable from the standard vision-impaired version. There are a number of problems which must be addressed in the design for such a knob. It should be held firmly in place and yet be relatively easy to remove. Its appearance should be compatible with the overall appearance of the thermostat. And it should allow the scale on the front face to be visible irrespective of the thermostat setting.

These problems are effectively addressed by forming in the external shape of the standard thermostat knob a first detent feature which comprises a part of a detent mechanism for retaining the knob accessory on the standard thermostat knob. The knob accessory itself includes a cylindrical wall forming the knob accessory's periphery. A face portion of the knob accessory is unitary with the periphery and extends toward the center from the periphery of the knob accessory. A central wall of the knob accessory which is unitary with the face portion defines a central opening having a shape which mates with the projecting wall of the thermostat knob. Within said central wall, there is a second detent feature which mates with the first detent feature to form therewith the detent mechanism when the knob accessory is mounted on the thermostat knob by mating the central opening with the wall of the thermostat knob. The detent mechanism retains the knob accessory on the thermostat knob, and at the same time allows it to be removed if necessary. When mounted on the thermostat knob, the central wall of the knob accessory surrounds the wall of the thermostat knob.

DESCRIPTION OF THE PREFERRED EMBODIMENTS

Figure 1:
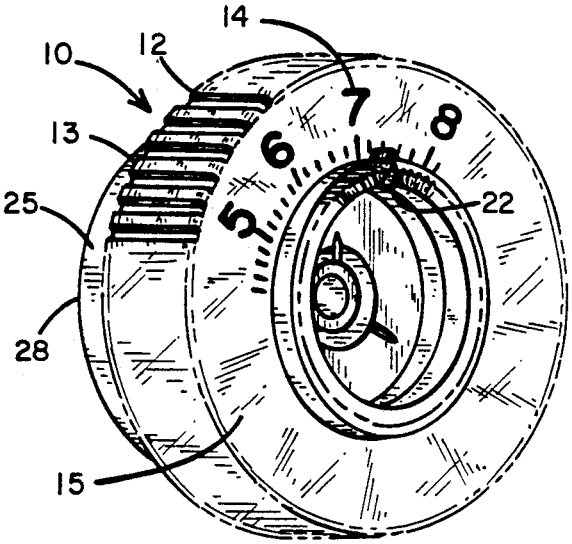
FIG. 1 is a perspective view of a thermostat assembly including the mounted knob accessory.
Figure 3:
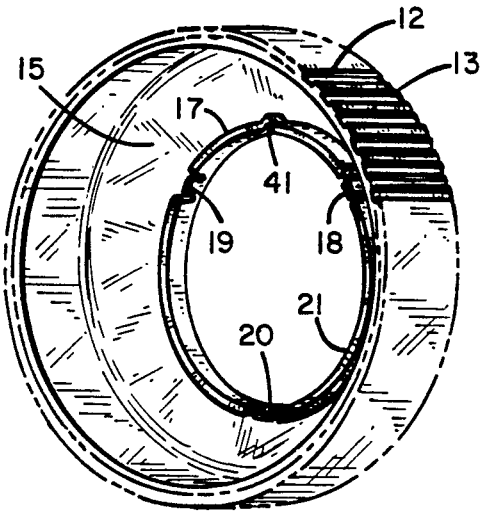
FIG. 3 is a perspective view of the rear of the knob accessory.
Figure 2:
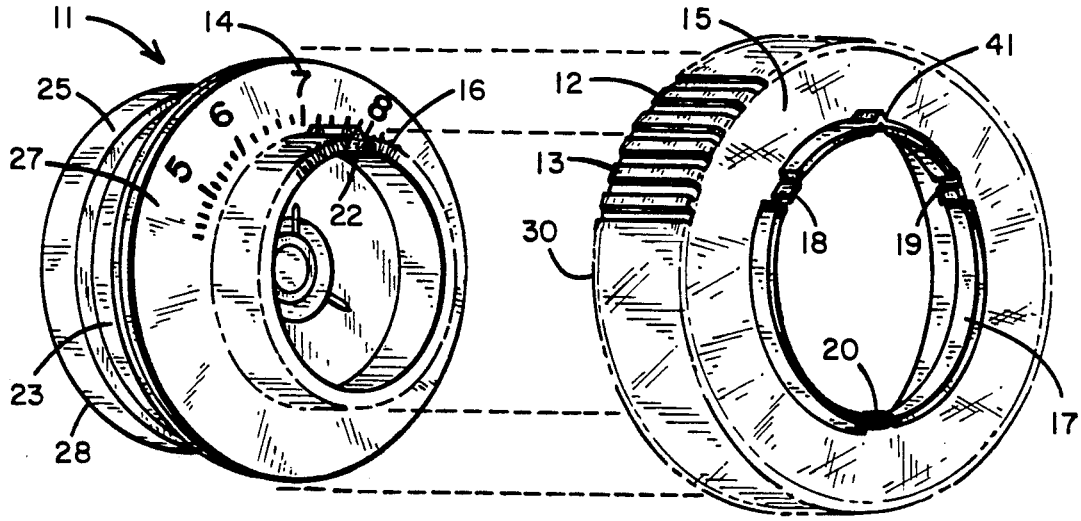
FIG. 2 is an exploded perspective view of the thermostat and the knob accessory showing how the knob accessory mounts on the thermostat knob.

FIGS. 1 and 2 show a thermostat assembly 10 which incorporates the invention. The exploded view of FIG. 2 allows the viewer to more easily see the features of the vision impaired thermostat 11. The housing of thermostat 11 has a generally circular periphery defining a central axis (shown at 24 in FIGS. 4 and 5) and includes a front face 27 carrying a thermostat setting scale having unusually large numerals 14. The front face 27 is supported by an integral cowling 23 which in turn is supported by a base 25. The base 25 is intended to be attached to a so-called sub-base which makes the electrical connections between the thermostat wires and the thermostat 11 itself. Base 25 has a rear edge 28 which defines a plane. The setting of thermostat 11 is adjusted by a central thermostat knob 16 which may be rotated about an axis coinciding with the central axis of thermostat 11 to select the desired setting. Knob 16 includes a cylindrical wall which projects through the surface of face 27. A pointer 22 radially projects from the wall of knob 16 to indicate the current temperature selection on the front face's scale. Pointer 22 is easier to see in the detail of FIG. 7. Knob 16 has knurling or ridging around the periphery of its wall to provide a non-slip gripping surface. A thermometer may be mounted within the knob 16 to display the current temperature.

This thermostat 11 provides an enormous advantage for visually impaired persons who wish by themselves to accurately adjust the temperature setting in their own residence. But the detents provided to indicate each two degree step in the rotation of the knob 16 cause the previously mentioned problem with this impaired vision version of the round thermostat, that persons with limited strength may not be able to easily rotate knob 16 against the resistance of the detents.

Figure 8:
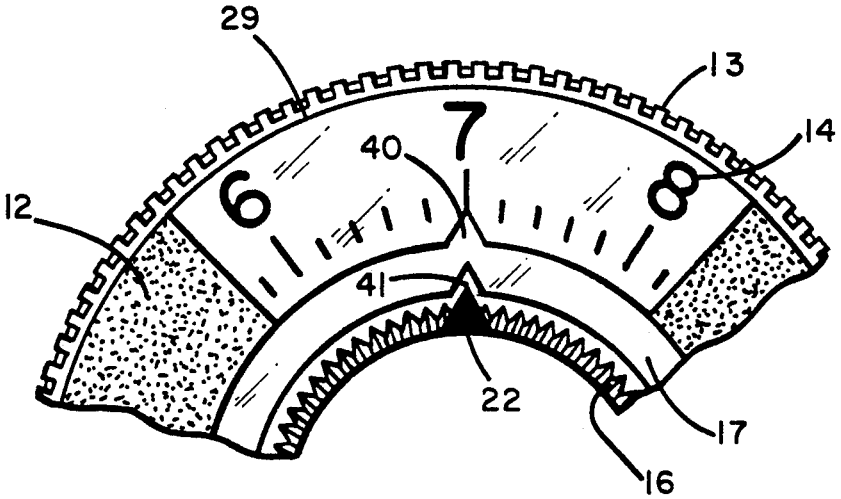
FIG. 8 is a detail from a frontal view of the assembled thermostat and knob accessory where the knob accessory is made of opaque material with a window through which a part of the thermostat scale is always visible.

A knob accessory 12 which forms a part of this invention, solves this problem in a substantial number of cases. What we consider to be a significant feature of the invention comprises the attachment interface between the knob accessory 12 and the thermostat knob 16. The knob accessory 12 has a substantially larger diameter and depth than does the standard thermostat knob 16. Around this large periphery the knob accessory 12 has a cylindrical outer wall 13 with deep grooving or ridging to form a gripping surface by which a person with limited strength can easily change the setting of thermostat 11. Outer wall 13 has an annular rear surface 30. The inside diameter of the outer wall 13 is greater than the diameter of the thermostat housing. When the knob accessory 12 is mounted on the knob 16, its outer wall 13 extends toward the rear edge 28 of the thermostat's base 25, at least partially surrounding the housing of thermostat 11 and creating a clearance space between the plane of rear edge 28 and the rear surface 30 of the knob accessory 12. The knob accessory 12 has a clear front face portion 15 through which the scale on the thermostat's face 27 can be clearly seen. Face portion 15 extends inwardly from the outer wall 13 and preferably is unitary therewith, and faces generally forwardly toward the user and away from the rear surface 30. When knob accessory 12 is properly mounted on knob 16, a small clearance space exists between the thermostat's front face 27 and the face portion 15 of knob accessory 12. We prefer to mold knob accessory 12 in one piece from a transparent plastic to allow a user to see the scale on thermostat face 27 when knob accessory 12 is mounted on knob 16. An opening 29 of the proper size and placement in the face portion 15 as shown in FIG. 8 will also provide an adequate view of the scale on thermostat face 27, in which case knob accessory 12 can be formed from an opaque material. Such an opening 29 avoids the potential for glare on the face portion 15 which may obscure numbers 14 from the viewer, particularly those having a vision impairment.

Figure 4:
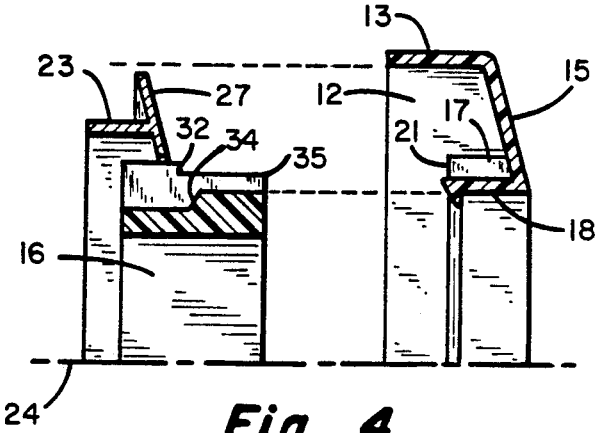
FIG. 4 is a side section of the exploded view of FIG. 2, with the section passing through the flexible finger.-,18.
Figure 5:
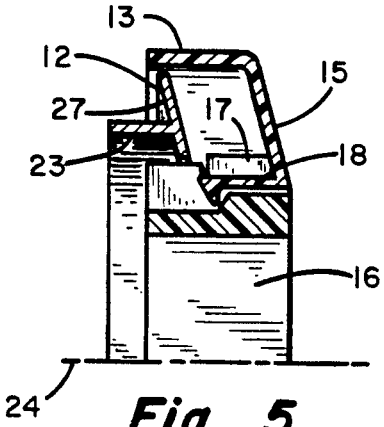
FIG. 5 is a side section of the assembled view of FIG. 1 with the section passing through the flexible finger 18.
Figure 6:
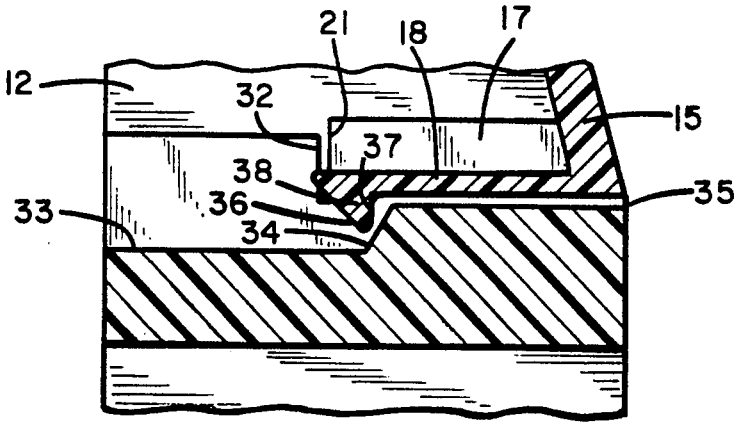
FIG. 6 is a detail section of the detent mechanism which retains the knob accessory on the thermostat knob.

In explaining the mechanism by which knob accessory 12 is attached to knob 16, it is necessary to refer to FIGS. 4–6. The knob accessory 12 has a circular central opening in the face portion 15 with a cylindrical inner wall 17 depending from the face portion 15 and delineating the central opening. The inside diameter of inner wall 17 is slightly larger than the diameter of the thermostat's adjustment knob 16 outside diameter, which allows the central opening of knob accessory 12 to mate with the wall of knob 16, with the inner wall 17 of the knob accessory 12 surrounding the projecting wall of knob 16. The inner wall 17 should fit snugly on the projecting wall of knob 16 so as to avoid wobble or play between knob accessory 12 and knob 16.

Knob accessory 12 is retained on thermostat knob 16 by three detent mechanisms each including one of the axially extending fingers 18, 19, and 20 fixed to the inner wall 17. Each of the fingers 18–20 carries at its end an inwardly directed, radially extending projection such as shown at 38 on finger 18 in FIG. 6. Each projection 38 etc. engages a radially inward extending recess in knob 16 which is aligned with its associated projection. Each of the three detent mechanisms comprising one of the fingers 18–20 and its attached projection 38 etc., along with the associated recess on the periphery of knob 16 is essentially identical to the other two in structure. This makes it convenient to describe the operation of each of the detent mechanisms with reference to finger 18 and the features cooperating with it, and whose operation and structure is detailed in FIGS. 4–6. A single detent mechanism may in fact be sufficient in many circumstances to retain knob accessory 12 on thermostat knob 16.

The recess in which the projection 38 carried at the end of finger 18 engages has a floor 33 and is defined at a forward end by a short radially extending end wall 34. The width of each recess is slightly greater than the width of its associated projection 38 etc. Projection 38 is spring mounted on knob accessory 12 by virtue of the flexibility in finger 18 which allows projection 38 to resiliently deflect radially with respect to the axis of rotation 24. The projection 38 on finger 18 can be seen to extend radially and inwardly a short distance from finger 18 with an axially facing detent surface 37 and a diagonal cam surface 36 facing inwardly and toward the central axis 24. When it is desired to mount knob accessory 12 on knob 16, the inner wall opening is aligned with the outer surface of knob 16 and the knob accessory 12 is pressed onto knob 16. The resiliency in finger 18 is overcome by radially directed camming force generated by the interaction between surface 36 and the outer, interior edge 35 of the central opening. Projection 38 is forced radially away from the central axis by the axial force and slides axially along the outer surface of knob 16. When the detent surface 37 passes the recess end wall 34, the restoring force in finger la causes projection to snap radially toward the floor 33 of the recess, thereby creating an interference between detent surface 37 and end wall 34. This interference opposes a later attempt to remove knob accessory 12 from knob 16 and therefore retains knob accessory 12 on knob 16. When it is desired to remove knob accessory 12 from knob 16, axial force urging knob accessory 12 rightward with respect to knob 16 as shown in FIGS. 4–6 again causes projection 38 to cam against end wall 34 and again deflect projection 38 radially outward. Knob accessory 14 can then be easily removed from knob 16.

In order to assure accurate and solid axial positioning of knob accessory 12 on knob 16, an annular abutment 32 is placed around the projecting wall of knob 16. The end surface 21 of the central wall 17 carried by knob accessory 12 contacts abutment 32 when knob accessory 12 has slid axially on knob 16 to the desired position. In this position there is a clearance space between the rear edge of wall 13 and the plane defined by the rear edge 28 of base 25. This clearance space allows ambient air to flow unobstructed through the enclosed space of thermostat 11 so that the ambient air temperature can be accurately controlled. There are a number of other suitable arrangements allowing the axial position of knob accessory 12 on knob 16 to be properly fixed.

Figure 7:
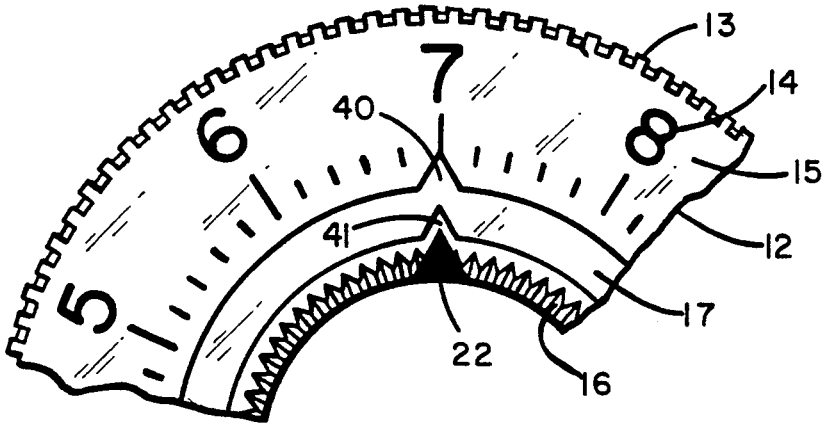
FIG. 7 is a detail from a frontal view of the assembled thermostat and knob accessory showing the alignment feature of the knob accessory and the thermostat knob.

Correct angular alignment between knob accessory 12 and knob 16 is necessary in order to assure that the recesses are aligned with their respective projections 38 etc. Features on knob 16 and knob accessory 12 cooperatively form an alignment feature which restricts the angular orientation of the knob accessory 12 when mounted on knob 16 to a single preselected position. Referring to FIG. 7, pointer 22 projects radially outwards from the wall defining knob 16. Pointer 22 forms a spline which serves as an alignment projection and which, by engaging a slot or keyway 41 serving as an alignment recess in the central opening of knob accessory 12, aligns the angle of the knob accessory 12 with knob 16. It is convenient to have a further projection 40 on the outer surface of the central wall 17 to clearly indicate the angular position of the knob accessory 12. Of course, an alternate design may locate the keyway on the periphery of knob 16 and the spline on the central opening of knob accessory 12. However, with the projecting pointer 22 already present on the periphery of knob 16, the arrangement shown in FIG. 7 is preferred.

We claim:

1. In a round thermostat of the type including a housing having a generally circular periphery with a central axis and for adjustment of the thermostat setting, a thermostat knob having an axis of rotation coinciding with the central axis and a predetermined external shape comprising a wall projecting from the housing, an improved knob accessory for the thermostat comprising in the thermostat, a first detent feature in the external shape of the thermostat knob forming a part of a detent mechanism and comprising at least one peripheral area having a radially extending recess, and wherein the knob accessory includes a cylindrical outer wall forming the knob accessory's periphery and a face portion joined to the outer wall and extending towards the center from the periphery, said face portion defining a central opening having a shape which mates wit the projecting wall of the thermostat knob, and adjacent said central wall, a second detent feature mating with the first detent feature to form therewith the detent mechanism when the knob accessory is mounted on the thermostat nob by mating the central opening with the wall of the thermostat knob and with the central wall of the knob accessory surrounding the wall of the thermostat knob, said second detent feature comprising a radially extending spring-loaded projection entering the recess in the thermostat knob when the knob accessory is mounted on the thermostat knob.

2. The improvement of claim 1, wherein the knob accessory's spring-loaded projection is centrally directed.

3. The improvement of claim 1, wherein the spring-loaded projection comprises an axially extending flexible finger carrying on its end the projection.

4. The improvement of claim 3, wherein the thermostat knob and the knob accessory cooperatively form an alignment feature for restricting to a single preselected position, the angular orientation of the knob accessory to the thermostat knob when mounted thereon, comprising an alignment projection on one of the thermostat knob and the central wall of the knob accessory and an area in the other of the thermostat knob and the central wall of the knob accessory having an alignment recess which engages with the alignment projection when the angular orientation of the knob accessory has its preselected position with respect to the thermostat knob when mounted thereon.

5. The improvement of claim 4, wherein the thermostat knob carries the alignment projection and the knob accessory carries the alignment recess.

6. The improvement of claim 2, wherein the thermostat knob includes a first stop wall adjacent to the projecting wall thereof, and wherein the knob accessory includes a second stop wall adjacent to the central wall thereof, and contacting the first stop wall when the detent mechanism is engaged.

7. The improvement of claim 1, wherein the thermostat is of the type having on a front face of the thermostat housing, a temperature scale for setting the thermostat, and wherein the face portion has a transparent portion across the temperature scale.

8. The improvement of claim 1, wherein the knob accessory is formed of transparent material.

9. In a round thermostat of the type including a housing having a generally circular periphery with a central axis and for adjustment of the thermostat setting, a thermostat knob having an axis of rotation coinciding with the central axis and a predetermined external shape comprising a wall projecting from the housing, an improved knob accessory for the thermostat comprising in the thermostat, a first detent feature in the external shape of the thermostat knob forming a part of a detent mechanism, and wherein the knob accessory includes a cylindrical outer wall forming the knob accessory's periphery and a face portion joined to the outer wall and extending towards the center from the periphery, said face portion defining a central opening having a shape which mates with the projecting wall of the thermostat knob, and within said central wall, a second detent feature mating with the first detent feature to form therewith the detent mechanism when the knob accessory is mounted on the thermostat knob by mating the central opening with the wall of the thermostat knob and with the central wall of the knob accessory surrounding the wall of the thermostat knob, and wherein the knob accessory face portion has a window in a predetermined area thereof.

10. In a round thermostat of the type including a housing having a generally circular periphery with a central axis and for adjustment of the thermostat setting, a thermostat knob having an axis of rotation coinciding with the central axis and a predetermined external shape comprising a wall projecting from the housing, wherein the thermostat housing is of a predetermined diameter and has a front face and a rear edge to be mounted adjacent to a room's wall, an improved knob accessory for the thermostat comprising in the thermostat, a first detent feature in the external shape of the thermostat knob forming a part of a detent mechanism, and wherein the knob accessory includes a cylindrical outer wall forming the knob accessory'periphery and a face portion joined to the outer wall and extending towards the center from the periphery, said face portion defining a central opening having a shape which mates wit the projecting wall of the thermostat knob, and within said central wall, a second detent feature mating with the first detent feature to form therewith the detent mechanism when the knob accessory is mounted on the thermostat nob by mating the central opening with the wall of the thermostat knob and with the central wall of the knob accessory surrounding the wall of the thermostat knob, and wherein the cylindrical wall forming the knob accessory's periphery has an inside diameter greater than the predetermine diameter of the thermostat housing, said knob accessory's cylindrical wall extending toward the rear edge of the thermostat housing and at least partially surrounding the thermostat housing.

11. The improvement of claim 10, wherein the rear edge of the thermostat housing defines a plane, and wherein the knob accessary's cylindrical wall has an end surface forming a clearance space between said end surface and the plane of the thermostat housing's rear edge when the knob accessory is mounted on the thermostat knob.

* * * * *